US006192686B1

(12) United States Patent
Coleman et al.

(10) Patent No.: US 6,192,686 B1
(45) Date of Patent: Feb. 27, 2001

(54) EXHAUST GAS RECIRCULATION SYSTEM

(75) Inventors: Gerald N. Coleman, Peoria; Dennis D. Feucht, Morton; Keith E. Lawrence, Peoria, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/273,888

(22) Filed: Mar. 22, 1999

(51) Int. Cl.[7] ..... F02B 33/44
(52) U.S. Cl. ..... 60/605.2
(58) Field of Search ..... 60/605.2; 123/446

(56) References Cited

U.S. PATENT DOCUMENTS

| | | | | |
|---|---|---|---|---|
| 3,149,454 | | 9/1964 | Hahn . | |
| 3,712,280 | | 1/1973 | Brille et al. . | |
| 4,048,968 | | 9/1977 | Aoyama . | |
| 4,231,225 | | 11/1980 | Aya . | |
| 4,702,218 | | 10/1987 | Yoshioka et al. . | |
| 4,738,110 | | 4/1988 | Tateno . | |
| 4,903,488 | | 2/1990 | Shibata . | |
| 5,203,311 | | 4/1993 | Hitomi et al. . | |
| 5,425,239 | | 6/1995 | Gobert . | |
| 5,540,203 | * | 7/1996 | Foulkes et al. | 123/446 |
| 5,617,726 | * | 4/1997 | Sheridan et al. | 60/605.2 |
| 5,771,868 | | 6/1998 | Khair | 123/570 |
| 5,806,308 | * | 9/1998 | Khair et al. | 60/278 |
| 5,927,075 | * | 7/1999 | Khair | 60/605.2 |
| 5,974,802 | * | 11/1999 | Blake | 60/605.2 |
| 6,062,026 | * | 5/2000 | Woollenweber et al. | 60/605.2 |

* cited by examiner

*Primary Examiner*—Thomas Denion
*Assistant Examiner*—Thai Ba Trieu
(74) *Attorney, Agent, or Firm*—Larry G. Cain

(57) ABSTRACT

Past exhaust emission control systems fail to utilize exhaust gas recirculation during all operating parameters of an engine. The present exhaust gas recirculation system reduces the emissions emitted from an engine during all operating parameters of the engine. The engine has a flow of intake air being at a first preestablished pressure and a flow of exhaust gas being at a first preestablished pressure being less that said first preestablished pressure of said intake air. The exhaust gas recirculation system is comprised of a portion of the flow of exhaust gas being recirculated to the cylinder and forming a flow of exhaust gas recirculation. The flow of exhaust gas recirculation is cooled. The flow of exhaust gas recirculation is compressed to a second preestablished pressure by a positive displacement pump. The second preestablished pressure of the flow of exhaust gas recirculation is at least equal to the first preestablished pressure of the intake air. A quantity of the flow of exhaust gas recirculation is controlled by an of-off valve or valves and/or a variable speed motor driving the positive displacement pump.

21 Claims, 2 Drawing Sheets

EXHAUST GAS RECIRCULATION SYSTEM

TECHNICAL FIELD

This invention relates generally to an engine and more particularly to a reduction of exhaust emissions.

BACKGROUND ART

The use of fossil fuel as the combustible fuel in engines results in the combustion products of carbon monoxide, carbon dioxide, water vapor, smoke and particulate, unburned hydrocarbons, nitrogen oxides and sulfur oxides. Of these above products carbon dioxide and water vapor are considered normal and unobjectionable. In most applications, governmental imposed regulations are restricting the amount of pollutants being emitted in the exhaust gases.

In the past, NOx emissions have been reduced by reducing the intake manifold temperature, retarding the injection timing, and modifying the injection rate shape. And, the adverse effects on fuel consumption, particulate emissions engine performance have largely been alleviated through improvements in the basic engine design and fuel selection. For example, at the present time smoke and particulates have normally been controlled by design modifications in the combustion chamber and injection pressure. Particulates are also controlled by traps and filters, and sulfur oxides are normally controlled by the selection of fuels being low in total sulfur. This leaves carbon monoxide, unburned hydrocarbons and nitrogen oxides as the emission constituents of primary concern in the exhaust gas being emitted from the engine.

Many systems have been developed for recycling a portion of the exhaust gas through the engine thereby reducing the emission of these constituents into the atmosphere. The recirculation of a portion of exhaust gas is used to reduce NOx pollution emitted to the atmosphere. In a naturally aspirated engine this process is relative simple. But, with a turbocharged engine, the recirculation of a portion of the exhaust gas into the intake air becomes more complex because the intake pressure may be higher than the exhaust pressure during many operating conditions. In many of such past system a volume of the exhaust gas from the engine was redirected to the intake air of the engine through the turbocharger and/or an aftercooler and to the engine. Such systems caused the premature plugging of aftercooler cores and malfunctioning of the systems. Additionally, with such recirculation system deterioration of the exhaust flow was caused by deposit buildup.

Various approaches have been used to address the adverse pressure gradient issue. For example, throttling valves have been installed in the air inlet, back pressure valves in the exhaust gas, intake manifold venturi tubes, etc. to provide sufficient pressure drop to get the exhaust gas to flow to the intake air. Although this provides the necessary pressure drop to functionally operate an exhaust gas recirculation system several disadvantages, such as, fuel consumption, emissions, and/or performance occur.

The present invention is directed to overcoming one or more of the problems as set forth above.

DISCLOSURE OF THE INVENTION

In one aspect of the invention an exhaust gas recirculation system is used with an engine. The engine defines a plurality of operating parameters, has a rotatable crankshaft through which an engine speed can be defined and a plurality of cylinders being defined as a part of the engine. The exhaust gas recirculation system is comprised of a flow of intake air entering a respective one of said plurality of cylinders. The intake air is pressurized to a preestablished pressure. A supply of combustible fuel enters the respective one of the plurality of cylinders. A combustion process within the respective one of the plurality of cylinders defines a flow of exhaust gas having a preestablished pressure being less than the preestablished pressure of the intake air during at least a portion of the engine operating parameters. A portion of the exhaust gas is circulated to the intake air defining a flow of exhaust gas recirculation. The flow of exhaust gas recirculation is cooled prior to being pressurized to a preestablished level and the pressurization of the flow of recirculated exhaust gas being by a positive displacement pump and being at a pressure at least equal to the preestablished pressure of the intake air. An on-off valve is interposed in the flow of exhaust gas recirculation. The on-off valve is movable between a closed position and an open position. And, in the open position the flow of exhaust gas recirculation is supplied to the positive displacement pump. A variable speed motor drives the positive displacement pump.

In another aspect of the invention an exhaust gas recirculation system is used with an engine having a plurality of operating parameters and a cylinder. The engine defines a speed. The engine has a flow of intake air being at a first preestablished pressure and a flow of exhaust gas being at a first preestablished pressure being less than the first preestablished pressure of the intake air during a portion of said plurality of operating parameters. The exhaust gas recirculation system is comprised of a portion of the flow of exhaust gas being recirculated back to the cylinder and forming a flow of exhaust gas recirculation. The flow of exhaust gas recirculation is cooled. A positive displacement pump compresses the flow of exhaust gas recirculation to a second preestablished pressure. The second preestablished pressure of the flow of exhaust gas recirculation is at least equal to the first preestablished pressure of the intake air. A quantity of the flow of exhaust gas recirculation is controlled by an on-off valve. The on-off valve is operatable between an open position and a closed position. And, a variable speed motor drives the positive displacement pump.

In another aspect of the invention a method of reducing exhaust emissions from an engine is disclosed. The engine has a plurality of operating parameters, a flow of intake air being at a first preestablished pressure, a flow of exhaust gas being at a first preestablished pressure being less than the preestablished pressure of the intake air during a portion of the operating parameters. The method of reducing exhaust emission is comprised of the steps of extracting a portion of the flow of exhaust gas forming a flow of exhaust gas recirculation. Cooling the flow of exhaust gas recirculation. Increasing the pressure of the flow of exhaust gas recirculation from the first preestablished pressure to a second preestablished pressure being at least equivalent to the first preestablished pressure of the flow of intake air. And, driving a positive displacement pump at a variable rate of speed and varying the variable rate of speed depending on an operating parameter of the plurality of operating parameters of the engine.

BEST MODE FOR CARRYING OUT THE INVENTION

Figure 1:
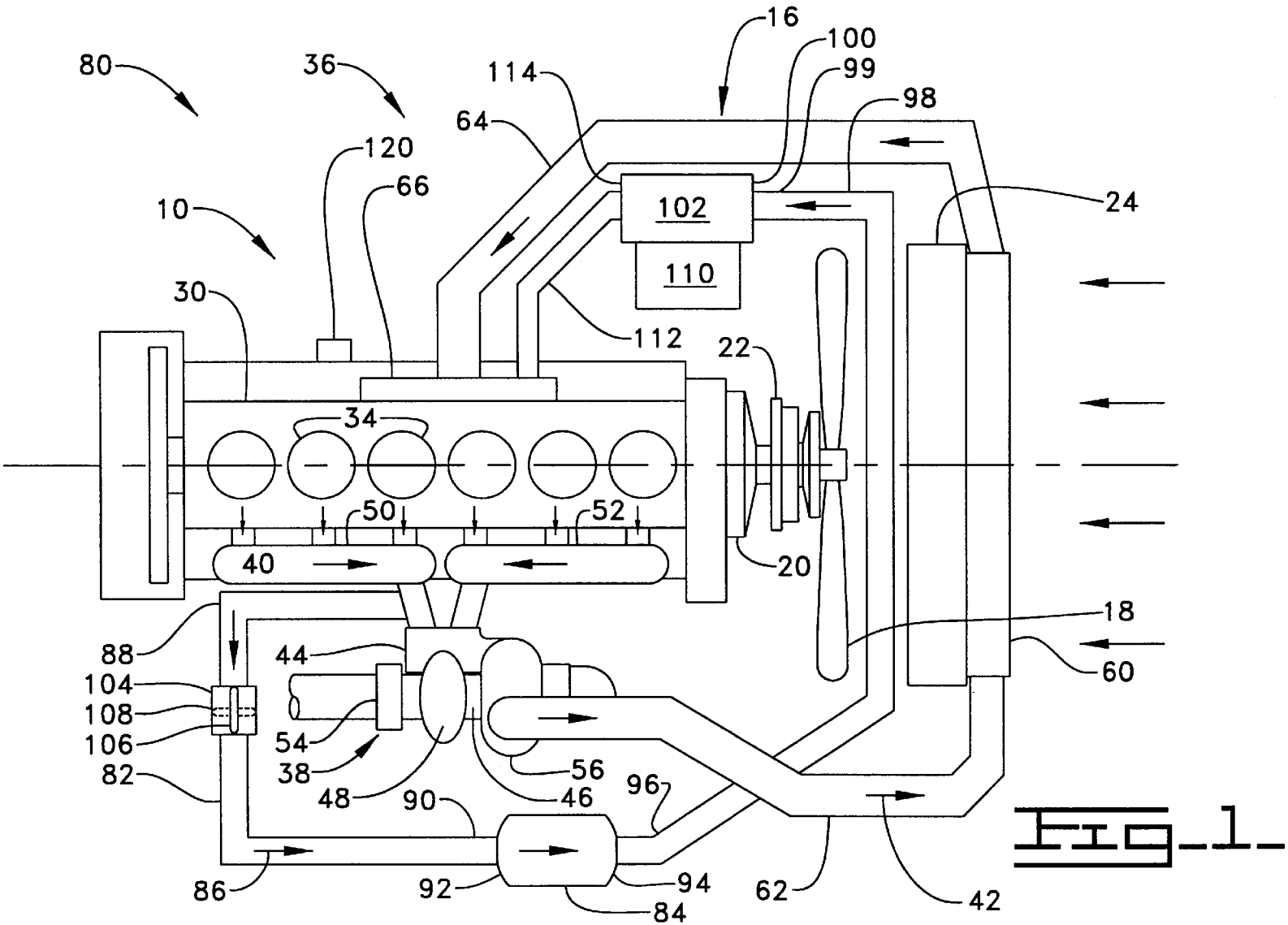
FIG. 1 is a schematic view of an engine embodying an exhaust gas recirculation system.

Referring to FIG. 1, an engine 10 is schematically shown. A conventional cooling system 16 is operatively connected to the engine 10 in a conventional manner. The cooling system 16, in this application, includes a fan 18 being attached to the engine 10 and being driven by a crankshaft 20 of the engine 10. The fan 18 is operatively driven by a belt 22 in a conventional manner. However, as an alternative, the fan could be driven by a motor being remotely attached in other conventional manners without changing the essence of the invention. A radiator 24 is connected to the engine 10 in a conventional manner and is a part of the cooling system 16. The radiator 24 operatively cools the engine 10 in a conventional manner.

The engine 10 includes a block 30 having a plurality of cylinder 34 therein. For example, an inline-6 cylinder is shown; however, as an alternative an inline-4 or a V configuration could be used without changing the essence of the invention. The engine 10 includes an air intake system 36 and an exhaust system 38. After a combustion process, a flow of exhaust gas designated by the arrows 40 exits each of the respective plurality of cylinders 34 at a first preestablished pressure. The flow of exhaust gas 40 exits through the exhaust system 38 in a conventional manner. A flow of intake air designated by the arrows 42 enters each of the respective plurality of cylinders 34 at a first preestablished pressure being greater than the first preestablished pressure of the exhaust pressure 40 through the air intake system 36 as will be defined later.

The exhaust system 38 includes an exhaust manifold 44 being attached to the block 30 and has the flow of exhaust gas 40 exiting the plurality of cylinders 34 of the engine 10 passing therethrough. A turbocharger 46 is a part of the exhaust system 38 and is attached to the engine 10, as will be explained further. A turbine section 48 is operatively connected to and driven by the flow of exhaust gas 40 from the combustion process within the plurality of cylinders 34. For example, in this application, a first exhaust manifold portion 50 is connected to a first set of three cylinders and a second set of three cylinders 34 are connected a second exhaust manifold portion 52. The turbine section 48 is connected to each of the first exhaust manifold portion 50 and the second exhaust manifold portion 52. The flow of exhaust gas 40 exits an exhaust opening 54 in the turbine section 48 and passes through a muffler, not shown, to the atmosphere. The turbocharger 46 further includes a compressor section 56 being driven by the turbine section 48 in a conventional manner.

The air intake system 36 is operatively connected to the compressor section 56 of the turbocharger 46 in a conventional manner. The flow of intake air 42 is communicated from the atmosphere through a filter, not shown, to the compressor section 56 of the turbocharger 46 in a convention manner. The compressor section 56 pressurizes the intake air 42 to the first preestablished level. During some operating parameters of the engine 10, the first preestablished level of the intake air 42 is above the pressure level of the exhaust gas 40. Other conventional system could be used to increase the pressure of the intake air 42 without changing the jest of the invention. The intake air 42 is communicated from the compressor section 56 through an aftercooler 60 by a first conduit 62. In this application, the aftercooler 60 is an air to air aftercooler being operatively positioned with the radiator 24 in a conventional manner. From the aftercooler 60, the intake air 42 passes through a second conduit 64 and operatively enters the respective one of the plurality of cylinders 34 through an intake manifold 66.

In one alternative, as best shown in FIG. 1, an exhaust gas recirculation system 80 is operatively attached to the engine 10. The exhaust gas recirculation system 80 includes a supply line 82 being operatively connected between the flow of exhaust gas 40 and an exhaust gas recirculation cooler 84. A flow of exhaust gas to be recirculated, designated by arrow 86, passes therethrough. The cooling of the exhaust gas recirculation cooler 84 can be of any convention means such as engine 10 jacket water cooling, air to air or an external cooling media. In this application, the supply line 82 has a first end portion 88 attached to the first exhaust manifold portion 50 at a position spaced at a predetermined distance from the intersection of the first exhaust manifold 50 and the second exhaust manifold portion 52 of the exhaust manifold 44. A second end 90 of the supply line 82 is attached to an inlet end portion 92 of the exhaust gas recirculation cooler 84. An outlet end portion 94 of the exhaust gas recirculation cooler 84 has a first end 96 of a first tube 98 attached thereto. A second end 99 of the first tube 98 is attached to an inlet portion 100 of a positive displacement pump 102. With the positive displacement pump, the exhaust gas recirculation 86 is pressurized to a second preestablished pressure being at least as high as the first preestablished pressure of the intake air 42. Interposed the first end portion 88 and the second end 90 of the supply line 82 is a control or on-off valve 104. The on-off valve 104 can be operable through a plurality of positions between an open position 106 and a closed position 108, shown in phantom, varying the area through which the exhaust gas recirculation 86 will flow.

The positive displacement pump 102 is attached to the engine 10 in a conventional manner and can be driven by the engine 10 crankshaft 20 in a conventional manner, such as, by a belt, or, as and alternative, a plurality of gears, neither shown. As an alternative the positive displacement pump 102 can be remotely spaces from the engine 10 without changing the jest of the invention. The positive displacement pump 102 is driven by a variable speed motor 110. In this application, the variable speed motor 110 is electrically driven but as an alternative could be hydraulically driven or be driven by another source. The electric motor drives the positive displacement pump 102 at a variable speed ratio as compared to an engine 10 speed measured at the crankshaft 20. The variable speed motor 110 can operate between a high speed of about 18,000 RPM and a low speed of about 500 RPM. However, at a given operating parameter the speed at which the positive displacement pump 102 is driven could be equivalent to that of the engine speed.

Figure 2:
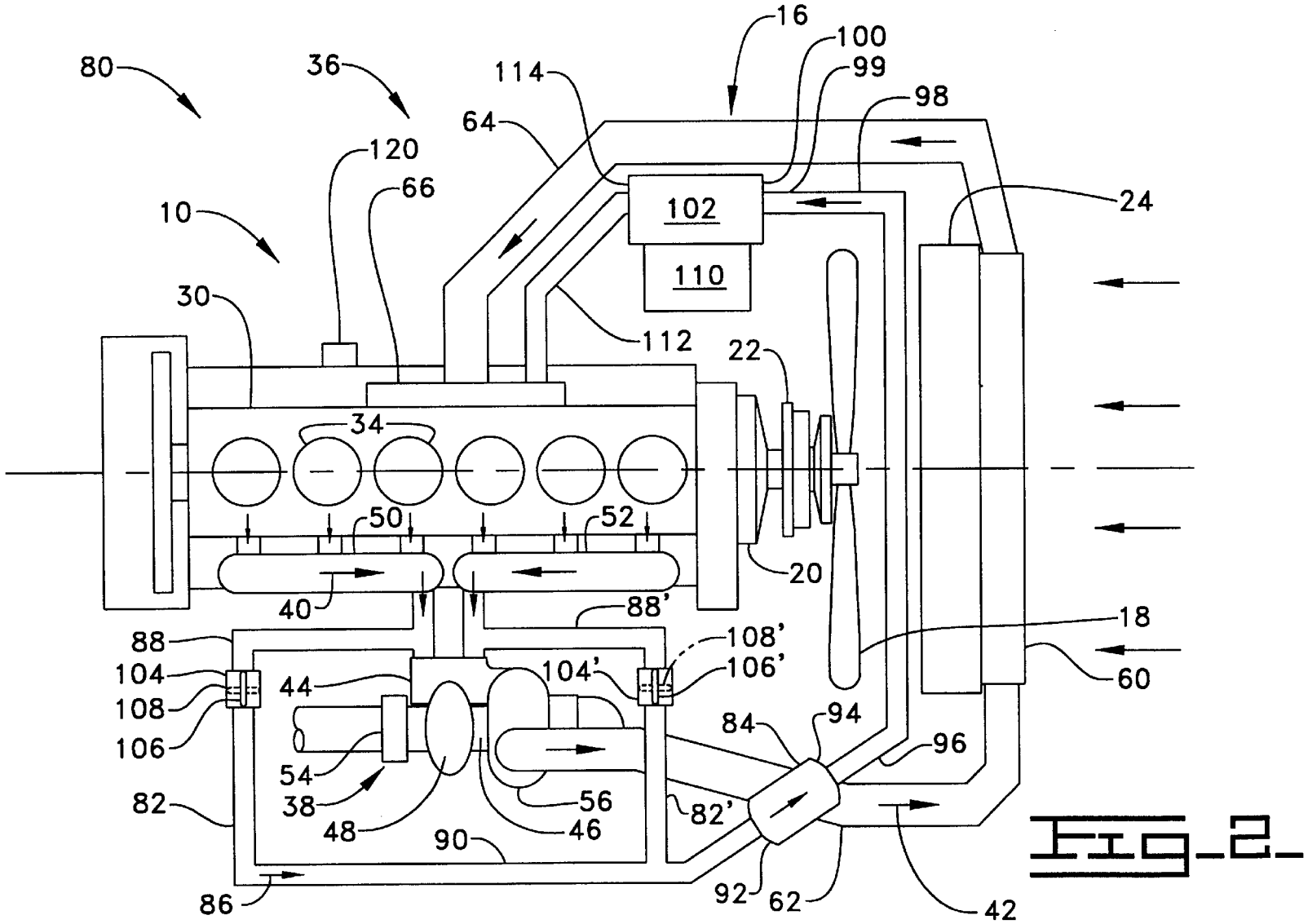
FIG. 2 is a schematic view of an engine embodying an exhaust gas recirculation system.

In another alternative, best shown in FIG. 2, an exhaust gas recirculation system 80' is shown. Like elements have been designate by a primed (') number. The exhaust gas recirculation system 80' is operatively attached to the engine 10. The exhaust gas recirculation system 80' includes a pair of supply lines 82' being operatively connected between the flow of exhaust gas 40 and the exhaust gas recirculation cooler 84. The flow of exhaust gas to be recirculated, designated by arrow 86, passes therethrough. The cooling of the exhaust gas recirculation cooler 84 can be of any convention means such as engine 10 jacket water cooling, air to air or an external cooling media. Each of the pair of supply lines 82' has a first end portion 88' attached to the first exhaust manifold portion 50 and the second exhaust manifold portion 52 respectively and at a position spaced at a predetermined distance from the intersection of the first exhaust manifold 50 and the second exhaust manifold portion 52 of the exhaust manifold 44. A second end 90' of each of the supply lines 82' is attached to the inlet end portion 92 of the exhaust gas recirculation cooler 84. The outlet end portion 94 of the exhaust gas recirculation cooler 84 has the first end 96 of the first tube 98 attached thereto. The second end 99 of the first tube 98 is attached to the inlet portion 100 of the positive displacement pump 102. Within the positive displacement pump 102, the exhaust gas recirculation 86 from each of the first exhaust manifold 50 and the second exhaust manifold 52 is pressurized to the second preestablished pressure being at least as high as the first preestablished pressure of the intake air 42. Interposed the first end portion 88' and the second end 90' of each of the supply line 82' is a control or on-off valve 104'. The on-off valve 104' can be operable through a plurality of positions between an open position 106' and a closed position 108', shown in phantom, varying the area through which the exhaust gas recirculation 86 will flow. With the exhaust gas recirculation system 80' as shown in FIG. 2, it is desirable to use a single actuator to control the position of the on-off valve 104'. The single actuator will control the position of the on-off valve 104' in each of the pair of supply lines 82' from the respective first exhaust manifold 50 and the second exhaust manifold 52.

The exhaust gas recirculation system 80,80' further includes a second tube 112 interposed an outlet portion 114 of the positive displacement pump 102 and the intake manifold 66.

A control system 120 operatively monitors engine 10 operating parameters and depending on the parameters of the engine 10 varies the position of the control or on-off valve 104 and the speed of the variable drive motor 110.

A conventional fuel system, not shown, is used with the engine 10.

Industrial Applicability

In use, the engine 10 is started. Fuel is supplied to each of the plurality of cylinders 34. Intake air 42 is supplied to the engine 10. For example, intake air 42 enters the compressor section 56 and is compressed increasing in pressure and temperature. From the compressor section 56, intake air 42 passes through the aftercooler 60, is cooled becoming more dense and enters into the intake manifold 66 and the respective one of the plurality of cylinders 34. Within the plurality of cylinders 34 the intake air 42 and the fuel are combusted. After combustion, the flow of exhaust gas 40 enters one of the first exhaust manifold portion 50 or the second exhaust manifold portion 52 of the exhaust manifold 44. The flow of exhaust gas 40 enters the turbine section 48 of the turbocharger 46 and drives the compressor section 56. After flowing through the turbocharger 46 the exhaust gas 40 exits through a muffler to the atmosphere.

With the engine 10 operating, the positive displacement pump 102 is operated at a variable speed ratio compared to the speed of the engine 10 crankshaft 20. The pump 102 increases the pressure of the exhaust gas recirculation 86 to the second preestablished pressure being at least as high as the first preestablished pressure of the intake air 42. In this application, depending on the operating parameter of the engine 10 the speed ratio of the positive displacement pump 102 to that of the engine 10 speed is varied, higher or lower, depending on the required quantity of exhaust gas recirculation 86 to be recirculated. For example, if the operating parameter of the engine 10 is at high speed light load, a large quantity or percentage of exhaust gas recirculation 86 is needed to be recirculated. The on-off valve or valves 104, 104' are moved into the open position 106,106' and the electric motor 110 is actuated by the control system 120 to operate at a high speed driving the positive displacement pump 102 at a high rate of speed. With the on-off valve or valves 104,104' in the open position 106,106' and the positive displacement pump 102 operating at the high speed, the large quantity of exhaust gas recirculation 86, 30 to 40 percent, will pass through the on-off valve or valves 104, 104' and the positive displacement pump 102 and enter the intake manifold 66. The resulting flow of exhaust gas recirculation 86 being pressurized at the second preestablished pressure level will enter the intake manifold 66 and mix with the intake air 42 since the pressure of the exhaust gas recirculation 86 is at least as high as the pressure of the intake air 42.

If during the operation of the engine 10 the operating parameter of the engine 10 is at a peak torque and a high load, a small quantity or percentage of exhaust gas recirculation 86 is needed to be recirculated. The control system 120 operates the positive displacement pump 102 at a low rate of speed. At peak torque the quantity or percentage of exhaust gas recirculation 86, 10 to 15 percent, will pass through the on-off valve or valves 104,104' and the positive displacement pump and enter the intake manifold 66. The resulting flow of exhaust gas recirculation 86 being pressurized at the second preestablished pressure level will enter the intake manifold 66 and mix with the intake air 42 since the pressure of the exhaust gas recirculation 86 is at least as high the pressure of the intake air 42.

Additionally, under some operating parameters of the engine 10 the need for exhaust gas recirculation 86 may not be needed. Thus, under these operating parameters the on-off valve or valves 104,104' are positioned in the closed position 108,108' and the variable speed motor 110 is off and the positive displacement pump 102 is also off.

Thus, the variable speed motor 10 has the capability to vary the speed of the positive displacement pump 102. The speed is controlled between the high flow at high speed and light load, the low flow at low speed and high load and off or no speed if not required. And, the on-off valve or valves 104,104' being used to rapidly turn off exhaust gas. Thus, the quantity of exhaust gas recirculation 86 can be effectively controlled. And, the emissions emitted from the engine 10 is controlled to an acceptable level.

The control system 120 operatively monitors engine 10 operating parameters and depending on the parameters of the engine 10 varies the speed of the electric motor 110 and the position of the on-off valve or valves 104,104'.

The exhaust gas recirculation system 80 overcomes the problem of flowing exhaust gas 40 into the engine 10 intake manifold 66 at times when the intake manifold 66 intake air 42 pressure is greater than the exhaust gas 40 pressure by use of the positive displacement pump 102 being driven by the variable speed motor 110. The on-off valve or valves 104, 104' can be used to completely shut off or control the quantity of the exhaust gas recirculation 86 flow.

Other aspects, objects and advantages of this invention can be obtained from a sturdy of the drawings, the disclosure and the appended claims.

What is claimed is:

1. An exhaust gas recirculation system for use with an engine, said engine defining a plurality of operating parameters, having a rotatable crankshaft through which an engine speed can be defined and a plurality of cylinders being defined as a part of the engine, said exhaust gas recirculation system comprising:

a flow of intake air entering a respective one of said plurality of cylinders, said intake air being pressurized to a preestablished pressure;

a supply of combustible fuel entering said respective one of said plurality of cylinders;

a combustion process within said respective one of said plurality of cylinders defining a flow of exhaust gas having a preestablished pressure being less than said preestablished pressure of said intake air during at least a portion of said engine operating parameters;

a portion of said exhaust gas being circulated to said intake air defining a flow of exhaust gas recirculation, said flow of exhaust gas recirculation being cooled prior to being pressurized to a preestablished level and said pressurization of said flow of recirculated exhaust gas being by a positive displacement pump and being at a pressure at least equal to said preestablished pressure of said intake air;

a control valve being interposed in said flow of exhaust gas recirculation; said control valve being movable between a closed position and an open position, and in said open position said flow of exhaust gas recirculation being supplied to said positive displacement pump; and a variable speed motor driving said positive displacement pump.

2. The exhaust gas recirculation system of claim 1 wherein said variable speed motor is an electric motor.

3. The exhaust gas recirculation system of claim 1 wherein said variable speed motor is a hydraulic motor.

4. The exhaust gas recirculation system of claim 2 wherein said variable speed motor is operable between a high speed of about 18,000 RPM and a low speed of about 500 RPM.

5. The exhaust gas recirculation system of claim 1 wherein said operating parameter of said engine being a high speed light load parameter and said variable speed motor driving said positive displacement pump at a high speed and said control valve being at said open position.

6. The exhaust gas recirculation system of claim 1 wherein said operating parameter of said engine being a low speed high load parameter and said variable speed motor driving said positive displacement pump at a low speed and said control valve being near said closed position.

7. The exhaust gas recirculation system of claim 6 wherein said control valve is near said closed position defining a minimum flow of exhaust gas recirculation.

8. The exhaust gas recirculation system of claim 1 wherein said flow of exhaust gas recirculation is cooled prior to being recirculated to said intake air.

9. An exhaust gas recirculation system for use with an engine having a plurality of operating parameters, a cylinder and said engine defining a speed, said engine having a flow of intake air being at a first preestablished pressure and a flow of exhaust gas being at a first preestablished pressure being less than said first preestablished pressure of said intake air during at least a portion of said plurality of operating parameters, said exhaust gas recirculation system comprising:

a portion of said flow of exhaust gas being recirculated back to said cylinder and forming a flow of exhaust gas recirculation and said flow of exhaust gas recirculation being cooled;

a positive displacement pump, said flow of exhaust gas recirculation being compressed to a second preestablished pressure by said positive displacement pump, said second preestablished pressure of said flow of exhaust gas recirculation being at least equal to said first preestablished pressure of said intake air; and a variable speed motor driving said positive displacement pump and said flow of exhaust gas recirculation being controlled by an operating speed of said variable speed motor.

10. The exhaust gas recirculation system of claim 9 wherein said flow of exhaust gas recirculation is at a maximum quantity with said variable speed motor being at a maximum speed.

11. The exhaust gas recirculation system of claim 10 wherein said control valve being at said open position.

12. The exhaust gas recirculation system of claim 9 wherein said flow of exhaust gas recirculation is at a minimum quantity with said variable speed motor being at a minimum speed.

13. The exhaust gas recirculation system of claim 9 wherein said variable speed motor being an electric motor.

14. The exhaust gas recirculation system of claim 9 wherein said variable speed motor being a hydraulic motor.

15. The exhaust gas recirculation system of claim 9 wherein said flow of exhaust gas recirculation being cooled prior to being compressed to said second preestablished pressure.

16. A method of reducing exhaust emissions from an engine defining a plurality of operating parameters and having a flow of intake air being at a first preestablished pressure, a flow of exhaust gas being at a first preestablished pressure being less than said preestablished pressure of said intake air during a portion of said plurality of operating parameters; said method of reducing exhaust emission comprising the steps of:

extracting a portion of said flow of exhaust gas forming a flow of exhaust gas recirculation;

cooling said flow of exhaust gas recirculation;

increasing said pressure of said flow of exhaust gas recirculation from said first preestablished pressure to a second preestablished pressure being at least equivalent to said first preestablished pressure of said flow of intake air; and driving a positive displacement pump at a variable rate of speed and varying said variable rate of speed depending on an operating parameter of said plurality of operating parameters of said engine.

17. The method of reducing exhaust emissions of claim 16 wherein said step of driving a positive displacement pump includes actuating an electric motor.

18. The method of reducing exhaust emissions of claim 16 wherein said step of driving a positive displacement pump includes actuating a hydraulic motor.

19. The method of reducing exhaust emissions of claim 16 wherein said step of extracting a portion of said flow of exhaust gas forming a flow of exhaust gas recirculation includes operating a control valve between an open position and a closed position.

20. The method of reducing exhaust emissions of claim 19 wherein said step of extracting a portion of said flow of exhaust gas forming a flow of exhaust gas recirculation includes said flow of exhaust gas recirculation being at a minimum quantity with said control valve being near said closed position.

21. The method of reducing exhaust emissions of claim 20 wherein said step of extracting a portion of said flow of exhaust gas forming a flow of exhaust gas recirculation and driving a positive displacement pump at a variable rate of speed and varying said variable rate of speed depending on a plurality of operating parameters of said engine is operatively connected by a control system.

* * * * *